US009661420B2

(12) United States Patent
Porter et al.

(10) Patent No.: US 9,661,420 B2
(45) Date of Patent: May 23, 2017

(54) MOVING COIL MOTOR ARRANGEMENT WITH A SOUND OUTLET FOR REDUCING MAGNETIC PARTICLE INGRESS IN TRANSDUCERS

(71) Applicant: Apple Inc., Cupertino, CA (US)

(72) Inventors: Scott P. Porter, Cupertino, CA (US); Ruchir M. Dave, San Jose, CA (US); Christopher R. Wilk, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 129 days.

(21) Appl. No.: 14/463,467

(22) Filed: Aug. 19, 2014

(65) Prior Publication Data

US 2016/0057541 A1 Feb. 25, 2016

(51) Int. Cl.

| | |
|---|---|
| ***H04R 9/02*** | (2006.01) |
| *H04R 9/04* | (2006.01) |
| *H04R 1/02* | (2006.01) |

(52) U.S. Cl.

CPC ..... *H04R 9/025* (2013.01); *H04R 1/023* (2013.01); *H04R 9/046* (2013.01); *H04R 2209/022* (2013.01); *H04R 2209/024* (2013.01); *H04R 2499/11* (2013.01)

(58) Field of Classification Search

CPC ..... H04R 9/025; H04R 25/65; H04R 9/06; H04R 2209/022; H04R 1/00; H04R 2499/11; H04R 9/027; H04R 25/658; H04R 9/02; H04R 31/006; H04R 1/02; H04R 1/1016; H04R 11/02; H04R 1/1091; H04R 1/2807; H04R 11/00; H04R 1/026; H04R 2209/024

USPC ..... 381/322, 345, 396, 398, 400, 420, 433, 381/412–414

See application file for complete search history.

(56) References Cited

U.S. PATENT DOCUMENTS

| | | | |
|---|---|---|---|
| 2,537,723 | A | 1/1951 | Ward |
| 4,429,194 | A | 1/1984 | Kamon et al. |

(Continued)

OTHER PUBLICATIONS

Hiebel, Holger, "A Parametric Study of Magnet System Topologies for Microspeakers", Engineering Brief EB2, 130th AES Convention, London, UK, (May 13-16, 2011), 5 pages.

*Primary Examiner* — Davetta W Goins
*Assistant Examiner* — Oyesola C Ojo
(74) *Attorney, Agent, or Firm* — Blakely, Sokoloff, Taylor & Zafman LLP

(57) ABSTRACT

An electromechanical transducer including a magnetic circuit having a magnet configured to generate a magnetic field and a magnetic gap into which a voice coil associated with a diaphragm is at least partially inserted, the magnetic field having a primary flux component and a secondary flux component. The transducer further including a housing positioned around the magnetic circuit, the housing having an acoustic spout whose sound outlet opening is positioned outside of a portion of the magnetic field that is dominated by the primary flux component. A transducer including an enclosure having a top wall, a bottom wall, at least one side wall connecting the top wall to the bottom wall and an acoustic spout extending from the top wall or the bottom wall, a diaphragm, a voice coil and a magnet assembly having a ring magnet and a gap within which the voice coil is positioned.

19 Claims, 6 Drawing Sheets

(56) References Cited

U.S. PATENT DOCUMENTS

| | | | | |
|---|---|---|---|---|
| 4,492,827 | A * | 1/1985 | Shintaku | H04R 1/30 381/412 |
| 4,736,435 | A | 4/1988 | Yokoyama et al. | |
| 6,611,605 | B2 * | 8/2003 | Kim | H04R 9/025 381/396 |
| 7,024,015 | B2 | 4/2006 | Hasegawa et al. | |
| 7,499,555 | B1 * | 3/2009 | Isvan | H04R 1/1075 381/182 |
| 2004/0146173 | A1 * | 7/2004 | Pan | H04R 9/025 381/396 |
| 2006/0222199 | A1 * | 10/2006 | Abe | H04R 9/025 381/396 |
| 2006/0254852 | A1 * | 11/2006 | Chen | H04R 1/1016 181/160 |
| 2012/0170778 | A1 * | 7/2012 | Wei | H04R 9/06 381/191 |
| 2014/0056455 | A1 * | 2/2014 | Sakaguchi | H04R 1/2811 381/328 |
| 2015/0181345 | A1 * | 6/2015 | Cai | H04R 9/06 381/412 |

* cited by examiner

MOVING COIL MOTOR ARRANGEMENT WITH A SOUND OUTLET FOR REDUCING MAGNETIC PARTICLE INGRESS IN TRANSDUCERS

FIELD

An embodiment of the invention is directed to a magnetic motor structure arranged with respect to a sound outlet to reduce magnetic particle ingress within the transducer. Other embodiments are also described and claimed.

BACKGROUND

In modern consumer electronics, audio capability is playing an increasingly larger role as improvements in digital audio signal processing and audio content delivery continue to happen. In this aspect, there is a wide range of consumer electronics devices that can benefit from improved audio performance. For instance, smart phones include, for example, electro-acoustic transducers such as speakerphone loudspeakers and earpiece receivers that can benefit from improved audio performance. Smart phones, however, do not have sufficient space to house much larger high fidelity sound output devices. This is also true for some portable personal computers such as laptop, notebook, and tablet computers, and, to a lesser extent, desktop personal computers with built-in speakers. Many of these devices use what are commonly referred to as "microspeakers." Microspeakers are a miniaturized version of a loudspeaker which use a moving coil motor to drive sound output. In compact designs such as smart phones, the moving coil motor, which may be interpreted as including a diaphragm, a voice coil and a magnet assembly, is positioned in close proximity to the device sound output port. Such close proximity, however, may leave the moving coil motor, and its components, vulnerable to damage and/or acoustic distortion due to magnetic particle ingress through the sound output port if the product is exposed to a hostile environment which contains ferritic dust or other small ferrous particles.

SUMMARY

An embodiment of the invention is directed to a magnetic motor structure for a transducer arranged with respect to a sound outlet port such that the orientation of the magnetic field at, or near, the sound outlet (which may be a path for particle ingress) is opposed to the ingress direction in comparison to a transducer without the arrangement disclosed herein. In one embodiment, the invention is directed to an electromechanical transducer including a magnetic circuit having a magnet configured to generate a magnetic field and a magnetic gap into which a voice coil associated with a diaphragm is at least partially inserted, the magnetic field having circulating magnetic flux lines that may include a primary flux component and a secondary flux component. The primary flux component drives movement of the voice coil while the secondary flux component is a stray component of the primary component. At some spatial locations, the magnetic flux lines are dominated by a component (e.g. flux lines) aligned with the outlet axis (axially aligned) and at others dominated by a component (e.g. flux lines) perpendicular to the outlet axis (e.g. radially aligned). The transducer further includes a housing positioned around the magnetic circuit, the housing having an acoustic spout extending outward so that its sound outlet opening (or port) is positioned outside of a portion of the magnetic field dominated by the primary flux component, so that the chance of particle (e.g. metallic or magnetic particle) ingress through the sound outlet opening is reduced.

Another embodiment of the invention is directed to an electromechanical transducer including an enclosure having a top wall, a bottom wall, at least one side wall connecting the top wall to the bottom wall and an acoustic spout formed along one of the top wall, the bottom wall and the at least one side wall. A diaphragm is positioned within the enclosure. A voice coil is positioned along a face of the diaphragm. The transducer further includes a magnet assembly having a ring magnet and a yoke that form a gap within an opening of the ring magnet in which magnetic flux is concentrated, and a portion of the voice coil is positioned within the gap and the acoustic spout is positioned over the opening.

Another embodiment of the invention is directed to an enclosure having a top wall, a bottom wall, at least one side wall connecting the top wall to the bottom wall and an acoustic spout extending from the top wall. A diaphragm is positioned within the enclosure. A voice coil is positioned along a face of the diaphragm. A magnet assembly is also positioned within the enclosure and forms a gap within which a portion of the voice coil is positioned. The acoustic spout extends from a portion of the top wall that is between the magnet assembly and at least one sidewall such that it is outside of a portion of the magnetic field dominated by the axially aligned magnetic flux lines.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1A:
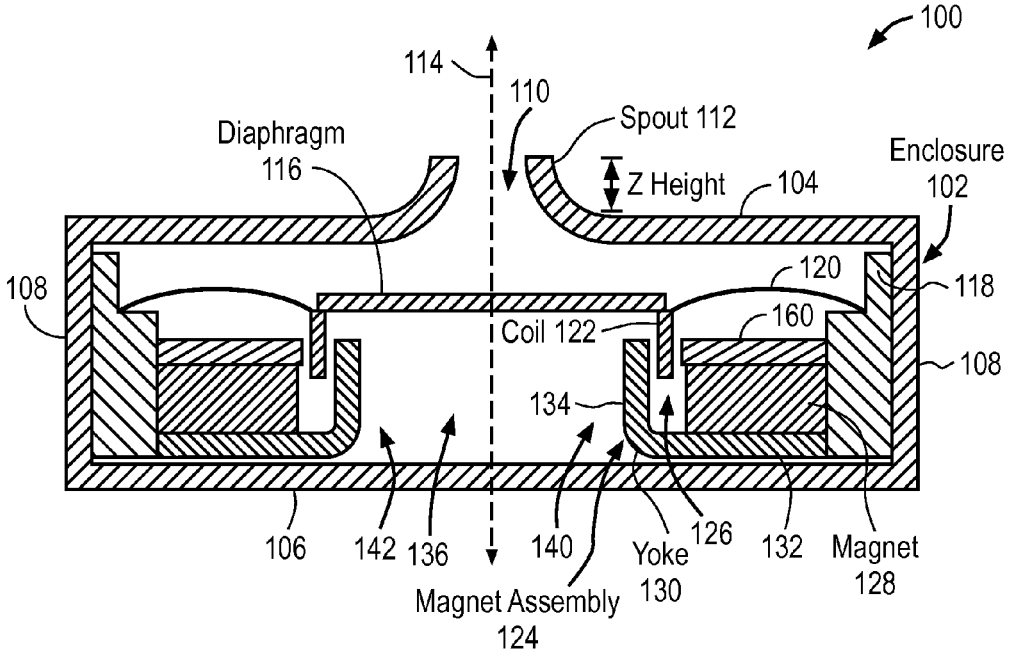
FIG. 1A illustrates a cross-sectional side view of one embodiment of a magnetic motor arrangement in a transducer.

FIG. 1A illustrates a cross-sectional side view of one embodiment of a magnetic motor arrangement in a transducer. Transducer 100 may be, for example, an electro-acoustic transducer that converts electrical signals into audible signals that can be output from a device within which transducer 100 is integrated. For example, transducer 100 may be a microspeaker such as a speakerphone speaker or an earpiece receiver found within a smart phone, or other similar compact electronic device such as a laptop, notebook, or tablet computer. Transducer 100 may be enclosed within a housing or enclosure 102 having a top wall 104, a bottom wall 106 and one or more sidewalls 108 connecting top wall 104 to bottom wall 106. Enclosure 102 may further include an acoustic spout 112 extending outward from one of top wall 104, bottom wall 106 or sidewalls 108. Acoustic spout 112 defines an acoustic opening or port 110 that provides a sound outlet opening, for example a primary outlet opening, through which sound generated by transducer 100 can be output to the ambient environment. In some embodiments, the opening or port 110 formed by spout 112 provides the only pathway for sound outlet from the enclosure 102. In addition, the enclosure may vent through small openings in bottom wall 106. In the illustrated embodiment of FIG. 1A, acoustic spout 112 is formed on top wall 104, in other words, above or over a diaphragm 116 having a sound radiating surface (SRS). In this aspect, transducer 100 may be considered a front-ported device. Acoustic spout 112 may, however, be formed on another wall of enclosure 102, for example, bottom wall 106 such that transducer 100 is considered a back or bottom-ported device.

In one embodiment, acoustic spout 112 may have a z-height dimension extending from an outer surface of enclosure 102. For example, acoustic spout 112 may form a lip like projection having acoustic port 110 at its end, through which sound generated by transducer 100 can travel to the ambient environment. Spout 112 may be designed to limit the area that particles can directly ingress through acoustic port 110 and/or limit the direction that particles can ingress. In this aspect, spout 112 helps to control, or reduce, particle ingress into transducer 100, as compared to a transducer having an opening through the wall without any sort of projection or spout 112. For example, spout 112 may have a z-height dimension that extends far enough from the surface of the enclosure wall such that off-axis particles traveling towards acoustic spout 112 (i.e. particles traveling at an angle with respect to device axis 114) are blocked from entering acoustic port 110 by spout 112 and therefore ingress into enclosure 102 is reduced. In addition, because of the z-height of spout 112, particles traveling along the top wall 104 of enclosure 102 (e.g. parallel to top wall 104) may be deflected up and away from acoustic port 110 by the sides of spout 112. Further, spout 112 may contain, or be adjacent to, a particle ingress protection mesh which can impede particles that are not aligned axially with spout 112. Spout 112, and in turn acoustic port 110, may in one embodiment, be formed on the top wall 104 of enclosure 102.

Diaphragm 116 may be suspended from a frame 118, which is mounted within enclosure 102 by a suspension member 120. Diaphragm 116 may include a sound radiating surface and be any type of diaphragm or sound radiating surface capable of vibrating in response to an acoustic signal to produce acoustic or sound waves. Transducer 100 may also include a voice coil 122 positioned along a face of diaphragm 116 and within a gap 126 formed by magnet assembly 124 which serves to concentrate the flux lines to improve the motor efficiency. In one embodiment, voice coil 122 may be positioned along a bottom face of diaphragm 116 (i.e. a side of diaphragm 116 facing bottom wall 106) and magnet assembly 124 may, in turn, be positioned below the bottom face of diaphragm 116 (i.e. between diaphragm 116 and bottom wall 106).

Magnet assembly 124 may include a magnet 128 (e.g. a NdFeB magnet) having a top plate 160 and a yoke 130 to form a magnetic circuit for the flux generated by magnet 128. Magnet assembly 124, including magnet 128, top plate 160 and yoke 130, may be positioned below diaphragm 116, in other words, magnet assembly 124 is positioned between diaphragm 116 and bottom wall 106. Said another way, diaphragm 116 is between magnet assembly 124 and spout 112. Gap 126, within which voice coil 122 is positioned, may be formed between yoke 130 and magnet 128. Representatively, in one embodiment, magnet 128 may be a ring magnet, such as a continuous ring magnet, having an open center portion 136 inside which the coil 122 may be positioned. Alternatively, magnet 128 may be a collection of discrete magnets arranged to form a ring around a perimeter of coil 122. In this aspect, magnet 128 may be positioned entirely outside of coil 122 (i.e. coil 122 is entirely within the open center portion 136 of magnet 128).

Figure 1B:
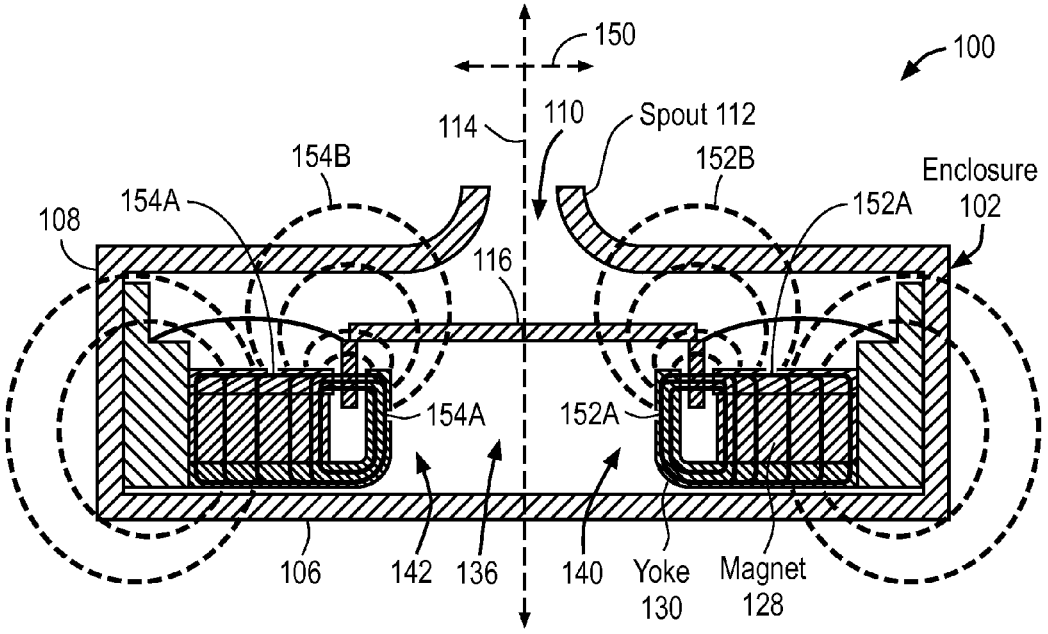
FIG. 1B illustrates a magnetic field of the magnetic motor arrangement of FIG. 1A.

Yoke 130 may include a substantially flat base portion 132 positioned along the bottom surface of magnet 128 and an arm portion 134 that extends upward from base portion 132, e.g. perpendicular to the base portion 132 such that that yoke 130 has an "L" shaped profile as shown in FIG. 1A and FIG. 1B. The arm portion 134 of yoke 130 may be positioned within open center portion 136 of magnet 128. Gap 126 for coil 122 is formed between arm portion 134 and the inner side of magnet 128 facing arm portion 134 in order to concentrate flux lines through the coil. In this aspect, the magnetic field produced by the magnetic circuit of magnet assembly 124 can be used to drive movement of coil 122, which in turn, vibrates diaphragm 116 in a manner sufficient to produce the desired acoustic output from transducer 100.

As previously discussed, acoustic port 110, and in turn spout 112, provide an opening to transducer 100 through which, in some cases, ferrous particles may ingress into a housing in which transducer 100 is located. Therefore, in one aspect of the invention, acoustic spout 112 and magnet assembly 124 of transducer 100 are arranged to reduce ferrous particle ingress through acoustic port 110. Representatively, in one embodiment, acoustic spout 112 reduces the pathway for particle ingress as compared to an acoustic port that does not include a spout as previously discussed. In addition, spout 112 is arranged with respect to magnet assembly 124 such that acoustic port 110 is outside of the magnetic field, or a portion of the magnetic field that would draw ferrous particles (e.g. iron filings), into acoustic port 110. Such arrangement is illustrated in FIG. 1B.

FIG. 1B illustrates a magnetic field of the magnetic motor arrangement of FIG. 1A. As can be seen from FIG. 1B, magnet assembly 124 produces a magnetic field having magnetic field or flux lines 140 and 142 between magnet 128 and yoke 130. As can be seen from FIG. 1B, flux lines 140 and 142 follow a substantially elliptical path between magnet 128 and yoke 130. In this aspect, portions of flux lines 140 and 142 can be considered aligned with a vertical axis 114 of magnet 128, in other words they are axially aligned flux lines, while other portions can be considered aligned with a radial dimension 150 of magnet 128, in other words they are radially aligned flux lines. In addition, flux lines 140 and 142 may be characterized as having a primary or main flux component 152A, 154A (illustrated in solid lines) and a secondary or stray flux component 152B, 154B (illustrated in dashed lines). The main flux component 152A, 154A is concentrated in the coil gap 126 and is designed to drive movement of coil 122. The stray flux component 152B, 154B is an unintended flux which extends outside of the main flux component 152A, 154A, respectively. In this aspect, the main flux component 152A, 154A may be understood to have a higher magnetic flux density than the stray flux component 152B, 154B. For example, the magnetic flux density near or within the main flux component 152A, 154A (e.g. over magnet 128) may be considered to be approximately twice that near or within the stray flux component 152B, 154B (e.g. the opening between magnet 128).

In general, particles in the presence of the stray flux component 152B, 154B will align themselves with the magnetic flux lines and experience a force along these flux lines (in either a positive or negative direction) that minimizes the gap between the magnet and the particle, the magnitude of this force being a function of the magnetic flux density within the particle. This flux density is, in turn, dependent on the position of the particle in the magnetic field and on the magnetic permeability of the particle itself. Particles in closer proximity to the magnet 128, and in turn the main flux component 152A, 154A will in general experience a higher attractive force toward the magnet 128, than those in closer proximity to the stray flux component 152B, 154B. Because of the general field lines for a magnet (e.g. magnet 128), particles situated directly in front of the pole faces will be attracted to the poles with a force with the dominant component aligned along the axis of the magnet's polarization which coincides with the axis of an associated acoustic opening. However, other particles that are situated in the direction of magnet's axis but offset in a direction perpendicular to the magnet's axis will experience a force that not only includes an axial component but a significant "radial" (radial here means perpendicular to the magnet/opening axis) component.

Moreover, particles in such a field will not only align with the magnetic flux lines, but, because of the self-magnetization, will by magnetic attraction form high-aspect structures along the field lines. If the axial field lines align with the axis of the acoustic opening, these structures are more easily able to transverse the acoustic opening (and any associated mesh) resulting in particle ingress. However, when a radial field component of the magnetic field is present across the acoustic opening, these structures no longer align in a direction normal to the opening (and any associated mesh) and thus are not aligned in a manner such that they may easily transverse the opening (and any associated mesh). Additionally the force acting on these particles is no longer parallel to the normal direction of the acoustic opening axis, or an associated mesh.

Thus, in order to reduce particle ingress due to the magnetic attraction, acoustic port 110, and in turn spout 112, is positioned such that it is within an area of reduced magnetic flux density. In other words, spout 112 is positioned outside of the area of the magnetic field 140, 142 dominated by the main flux component 152A, 154A, respectively. Said another way, spout 112 is positioned such that it is not aligned with the purely downward magnetic pull created over magnet 128 by the main flux component 152A, 154A. In other words, acoustic port 110, and in turn spout 112, is positioned over the opening 136 of magnet 128 such that it is not directly above magnet 128. Representatively, spout 112 may be positioned entirely outside of the magnetic field such that the strength of the magnetic field associated with the flux lines at or near spout 112 is significantly reduced (as compared to a spout positioned within the magnetic field), or spout 112 may be within the magnetic field, but outside of the area over magnet 128 (i.e. the area of highest flux density) such that the magnetic flux density (also referred to as the magnetic field strength) near spout 112 is reduced. For example, the magnetic flux density at the spout 112 may be reduced by about 10 mT, 20 mT, or 30 mT, as compared to a strength of the magnetic field not at or near spout 112 (e.g. directly over magnet 128). Thus, in some embodiments, spout 112 is positioned directly above an open center portion 136 of magnet 128 such that it is outside of an area of the magnetic field with the highest magnitude of flux density, particularly an axial component of the main flux component 152A, 154A. Said another way, spout 112 may be axially aligned with the center opening 136 of magnet 128. For example, spout 112 may be aligned with axis 114, or slightly offset with respect to axis 114, while still remaining over the open center portion 136 of magnet 128. It has been found that the spout 112 configuration and spout arrangement with respect to magnet assembly 124 as disclosed herein work synergistically to provide several advantages including, but not limited to, (1) limiting the area that particles can directly ingress, (2) limiting the direction that particles can ingress, and (3) reducing particle ingress due to the magnetic field.

In addition, it has been found that positioning spout 112 within the radially aligned flux lines (i.e. lines aligned with the radial dimension or axis 150), or a region of the magnetic field dominated by the radial flux lines (i.e. more radial flux lines than axial flux lines) may actually further reduce metallic or magnetic particle ingress through spout 112 because, for example, the radial flux lines may induce magnetic clumping and align and pull the particles across spout 112 rather than into spout 112.

Figure 2A:
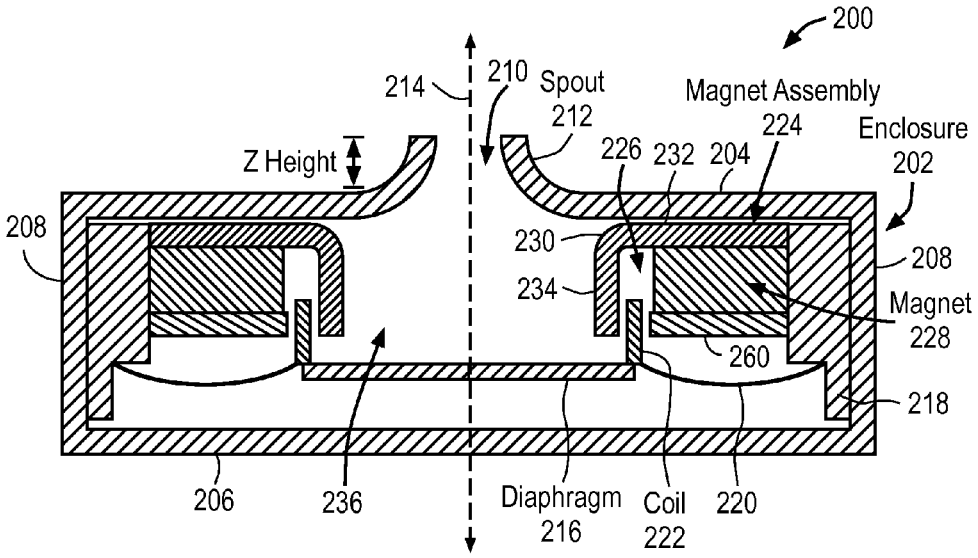
FIG. 2A illustrates a cross-sectional side view of another embodiment of a magnetic motor arrangement in a transducer.

FIG. 2A illustrates a cross-sectional side view of another embodiment of a magnetic motor arrangement in a transducer. Transducer 200 may be similar to transducer 100, for example, an electro-acoustic transducer that converts electrical signals into audible signals that can be output from a device within which transducer 200 is integrated. For example, transducer 200 may be a microspeaker such as a speakerphone speaker or an earpiece receiver found within a smart phone, or other similar relatively compact electronic device such as a laptop, notebook, or tablet computer. Transducer 200 may be enclosed within a housing or enclosure 202 having a top wall 204, a bottom wall 206 and one or more sidewalls 208 connecting top wall 204 to bottom wall 206. Enclosure 202 may further include an acoustic spout 212 formed through one of top wall 204, bottom wall 206 or sidewalls 208. Acoustic spout 212 defines an acoustic port 210 that provides a sound outlet port through which sound generated by transducer 200 can be output to the ambient environment. In the illustrated embodiment of FIG. 2A, acoustic spout 212 is formed through top wall 204, in other words, above or over diaphragm 216. In this aspect, transducer 200 may be considered a front-ported device. Acoustic spout 212 may, however, be formed through another wall of enclosure 202, for example, bottom wall 206 such that transducer 200 is considered a back or bottom-ported device.

Acoustic spout 212 may be substantially similar to acoustic spout 112 described in reference to FIG. 1A. In this aspect, acoustic spout 212 may have a z-height dimension extending from an outer surface of enclosure 202. Said another way, acoustic spout 212 may form a lip like projection through which sound generated by transducer 200 can travel to the ambient environment. Spout 212 may be designed to limit the area that particles can directly ingress through acoustic port 210 and/or limit the direction that particles can ingress. In this aspect, spout 212 helps to reduce particle ingress into transducer 200, as compared to a transducer having an opening through the wall without any sort of projection or spout 212. For example, spout 212 may have a z-height dimension that extends far enough from the surface of the enclosure wall such that off-axis particles traveling towards acoustic spout 212 (i.e. particles traveling at an angle with respect to device axis 214) are blocked from entering acoustic port 210 by spout 212. In addition, because of the z-height of spout 212, particles traveling along the outer wall of enclosure 202 may be deflected up and away from acoustic port 210 by the walls of spout 212.

Diaphragm 216 may be suspended from a frame 218 mounted within enclosure 202 by a suspension member 220. Diaphragm 216 may include a sound radiating surface and be any type of diaphragm or sound radiating surface capable of vibrating in response to an acoustic signal to produce acoustic or sound waves. Voice coil 222 may be positioned along a face of diaphragm 216 and within a gap 226 formed by magnet assembly 224. In this embodiment, voice coil 222 may be positioned along a top face of diaphragm 216 (i.e. a side of diaphragm 216 facing top wall 204) and magnet assembly 224 may, in turn, be positioned above or over the top face of diaphragm 216 (i.e. between diaphragm 216 and top wall 204) such that the diaphragm 216, voice coil 222 and magnet assembly 224 arrangement in FIG. 2A is reversed, or flipped, in comparison to that of FIG. 1A. In this arrangement the magnetic yoke 224 acts as a magnetic shield, reducing stray flux on the spout-side of the transducer.

Magnet assembly 224 may include a magnet 228 (e.g. a NdFeB magnet), an outer plate 260 and a yoke 230 for guiding a magnetic circuit generated by magnet 228. Magnet assembly 224, including magnet 228, outer plate 260 and yoke 230, may be positioned above diaphragm 216, in other words, in this embodiment, magnet assembly 224 is between diaphragm 216 and spout 212. Similar to FIG. 1A, gap 226, within which voice coil 222 is positioned, may be formed between yoke 230 and magnet 228. Representatively, in one embodiment, magnet 228 may be a ring magnet having an open center portion 236 that is positioned around coil 222. In this aspect, magnet 228 may be positioned entirely outside of coil 222 (i.e. coil 222 is entirely within the open center portion of magnet 228). Yoke 230 may include a substantially flat base portion 232 positioned along the top surface of magnet 228 and an arm portion 234 that extends from base portion 232 in a substantially perpendicular direction such that yoke 230 has a substantially "L" shaped profile. The arm portion 234 of yoke 230 may be positioned within open center portion 236 of magnet 228. Gap 226 for coil 222 is formed between arm portion 234 and the inner side of magnet 228 facing arm portion 234. In this aspect, the magnetic field produced by the magnetic circuit of magnet assembly 224 can be used to drive movement of coil 222, which in turn, vibrates diaphragm 216 in a manner sufficient to produce the desired acoustic output from transducer 200.

Similar to the acoustic spout described in reference to FIG. 1A, acoustic spout 112 is dimensioned (e.g. has a z-height dimension) to reduce the pathway for particle ingress as compared to an acoustic port that does not include a spout as previously discussed. In addition, spout 212 is arranged with respect to magnet assembly 224 such that acoustic port 210 (and spout 212) is outside of the magnetic field, or a portion of the magnetic field that would draw particles, for example metallic or magnetic particles (e.g. iron filings), into acoustic port 210. Such arrangement is illustrated in FIG. 2B.

In this arrangement, yoke 230 not only contributes to the motor efficiency, but also shields the magnet from leaking stray flux to the spout side.

Figure 2B:
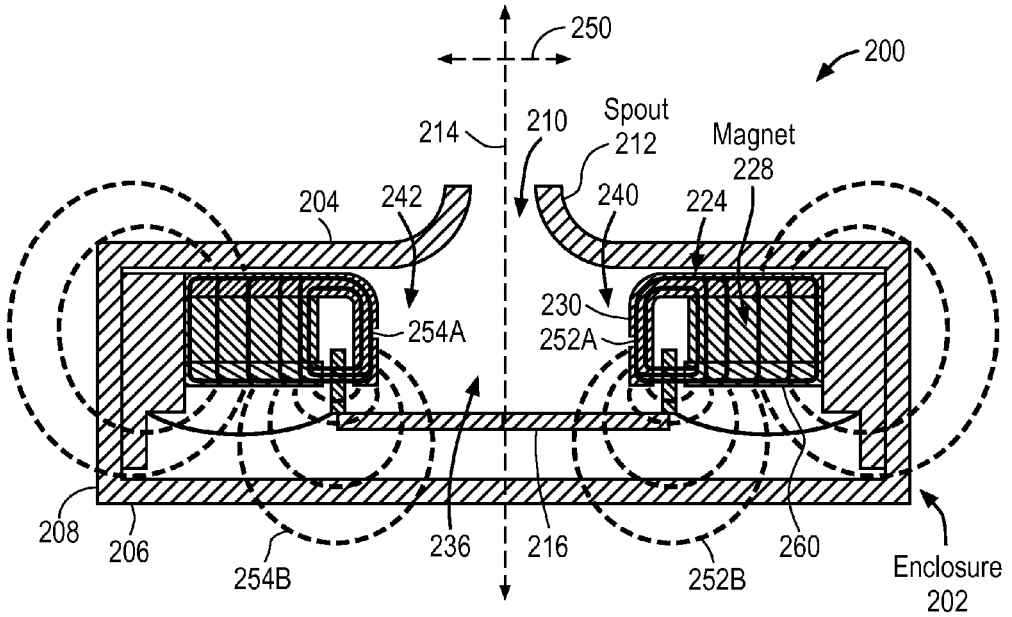
FIG. 2B illustrates a magnetic field of the magnetic motor arrangement of FIG. 2A.

FIG. 2B illustrates a magnetic field of the magnetic motor arrangement of FIG. 2A. As can be seen from FIG. 2B, magnet assembly 224 produces a magnetic field having magnetic field or flux lines 240 and 242 between magnet 228 and yoke 230. As can be seen from FIG. 2B, flux lines 240 and 242 follow a substantially elliptical path between magnet 228 and yoke 230. In this aspect, portions of flux lines 240 and 242 can be considered aligned with a vertical axis 214 of magnet 228, in other words they are axially aligned flux lines, while other portions can be considered aligned with a radial dimension 250 of magnet 228, in other words they are radially aligned flux lines. In addition, flux lines 240 and 242 may be characterized as having a main flux component 252A, 254A (illustrated in solid lines) and a stray flux component 252B, 254B (illustrated in dashed lines). The main flux component 252A, 254A is concentrated in the coil gap 226 and is designed to drive movement of coil 222. The stray flux component 252B, 254B is an unintended leakage in flux which extends outside of the main flux component 252A, 254A. In this aspect, the main flux component 252A, 254A may be understood to have a higher magnetic flux density than the stray flux component 252B, 254B. For example, the magnetic flux density near the main flux component 252A, 254A (e.g. over magnet 228) may be considered to be approximately twice that near the stray flux component 252B, 254B (e.g. over opening 236 of magnet 228).

Acoustic port 210, and in turn spout 212, is positioned such that it is outside of an area of higher magnetic flux density created by magnet assembly 224 such that particle ingress through spout 212 is reduced. In other words, spout 212 is positioned outside of the area of the magnetic field dominated by the main flux component 252A, 254A, particularly the axially aligned portions of the main flux component 252A, 254A. Said another way, spout 212 is positioned such that it is not aligned with axially aligned flux lines of the main flux component 252A, 254A. In this aspect, spout 212 may be positioned entirely outside of the magnetic field or within the magnetic field, but within an area where the strength of the magnetic field is reduced, for example, an area of reduced magnetic flux density. Said another way, spout 212 is offset with respect to the axis 214 of magnet 228. Thus, in some embodiments, spout 212 is positioned directly above an open center portion 236 of magnet 228, and not vertically aligned with magnet 228 such that it is outside of the area of highest flux density. Said another way, spout 212 may be axially aligned with the center opening 236 of magnet 228. It has been found that this combination of the spout 212 configuration and spout arrangement with respect to magnet assembly 224 provides several advantages including (1) limiting the area that particles can directly ingress, (2) limiting the direction that particles can ingress, and (3) reducing particle ingress due to the magnetic field.

It is further noted that in this embodiment, yoke 230 is between magnet assembly 224 and spout 212. For example, yoke 230 covers an area of magnet assembly 224 which would otherwise be exposed to spout 212. Since yoke 230 is not magnetic, it may provide a magnetic barrier or shield between magnet assembly 224 and spout 212 which acts to further reduce a magnetic field near spout 212 which could otherwise contribute to particle ingress through spout 212.

Figure 3A:
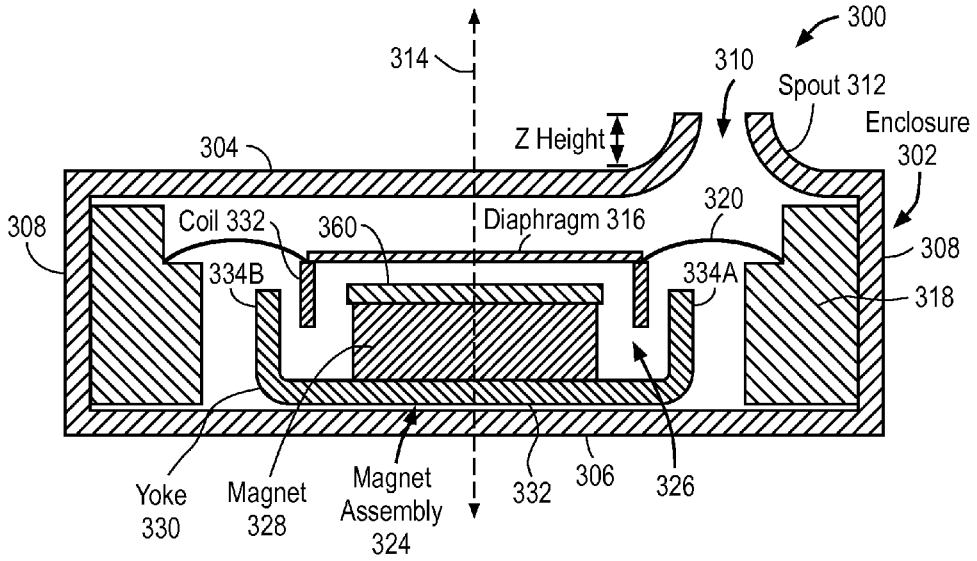
FIG. 3A illustrates a cross-sectional side view of another embodiment of a magnetic motor arrangement in a transducer.

FIG. 3A illustrates a cross-sectional side view of another embodiment of a magnetic motor arrangement in a transducer. Transducer 300 may be similar to transducer 100 described in reference to FIG. 1A, for example, an electro-acoustic transducer that converts electrical signals into audible signals that can be output from a device within which transducer 300 is integrated. For example, transducer 300 may be a loudspeaker such as a microspeaker or earpiece found within a smart phone, or other similar relatively compact electronic device such as a laptop, notebook, or tablet computer. Transducer 300 may be enclosed within a housing or enclosure 302 having a top wall 304, a bottom wall 306 and one or more sidewalls 308 connecting top wall 304 to bottom wall 306. Enclosure 302 may further include an acoustic spout 312 extending from one of top wall 304, bottom wall 306 or sidewalls 308. Acoustic spout 312 defines an acoustic port 310 that provides a sound outlet port through which sound generated by transducer 300 can be output to the ambient environment. In the illustrated embodiment of FIG. 3A, acoustic spout 312 is formed on top wall 304, in other words, above diaphragm 316. In this aspect, transducer 300 may be considered a front-ported device. Acoustic spout 312 may, however, be formed through another wall of enclosure 302, for example, bottom wall 306 such that transducer 300 is considered a back or bottom-ported device.

Acoustic spout 312 may be substantially similar to acoustic spout 112 described in reference to FIG. 1A. In this aspect, acoustic spout 312 may form a lip like projection through which sound generated by transducer 300 can travel to the ambient environment. Spout 312 may be designed to limit the area that particles can directly ingress through acoustic port 310 and/or limit the direction that particles can ingress. In this aspect, spout 312 helps to reduce particle ingress into transducer 300, as compared to a transducer having an opening through the wall without any sort of projection or spout 312. For example, spout 312 may have a z-height dimension that extends far enough from the surface of the enclosure wall such that off-axis particles traveling towards acoustic port 310 (i.e. particles traveling at an angle with respect to device axis 314) are blocked from entering acoustic port 310 by spout 312. In addition, because of the z-height of spout 312, particles traveling along the outer wall of enclosure 302 may be deflected up and away from acoustic port 310 by the walls of spout 312.

Diaphragm 316 may be suspended from a frame 318 mounted within enclosure 302 by a suspension member 320. Diaphragm 316 may include a sound radiating surface and be any type of diaphragm or sound radiating surface capable of vibrating in response to an acoustic signal to produce acoustic or sound waves. Voice coil 322 may be positioned along a face of diaphragm 316 and within a gap 326 formed by magnet assembly 324. In this embodiment, voice coil 322 may be positioned along a bottom face of diaphragm 316 (i.e. a side of diaphragm 316 facing bottom wall 306) and magnet assembly 324 may, in turn, be positioned below or under the bottom face of diaphragm 316 (i.e. between diaphragm 316 and bottom wall 306).

Magnet assembly 324 may include a magnet 328 (e.g. a NdFeB magnet), an outer plate 360 and a yoke 330 for guiding a magnetic circuit generated by magnet 328. Magnet assembly 324, including magnet 328, outer plate 360 and yoke 330, may be positioned below or under diaphragm 316, in other words, in this embodiment, magnet assembly 324 is between diaphragm 316 and bottom wall 306. Gap 326, within which voice coil 322 is positioned, may be formed between yoke 330 and magnet 328. Representatively, in one embodiment, magnet 328 may be a center magnet that is positioned within coil 322, both of which are surrounded by the yoke 330. The center magnet may be void of any openings, in other words solid without any hollow regions or openings. Yoke 330 may include a substantially flat base portion 332 positioned along the bottom surface of magnet 328 and arm portions 334A and 334B that extend from base portion 332 in a substantially perpendicular direction such that yoke 330 has a substantially "U" shaped profile. The arm portions 334A, 334B of yoke 330 may be positioned around the outer edges of magnet 328. Gap 326 for coil 322 is formed between arm portions 334A, 334B and the outer side of magnet 328 facing arm portions 334A, 334B. In this aspect, the magnetic field produced by the magnetic circuit of magnet assembly 324 can be used to drive movement of coil 322, which in turn, vibrates diaphragm 316 in a manner sufficient to produce the desired acoustic output from transducer 300.

Figure 3B:
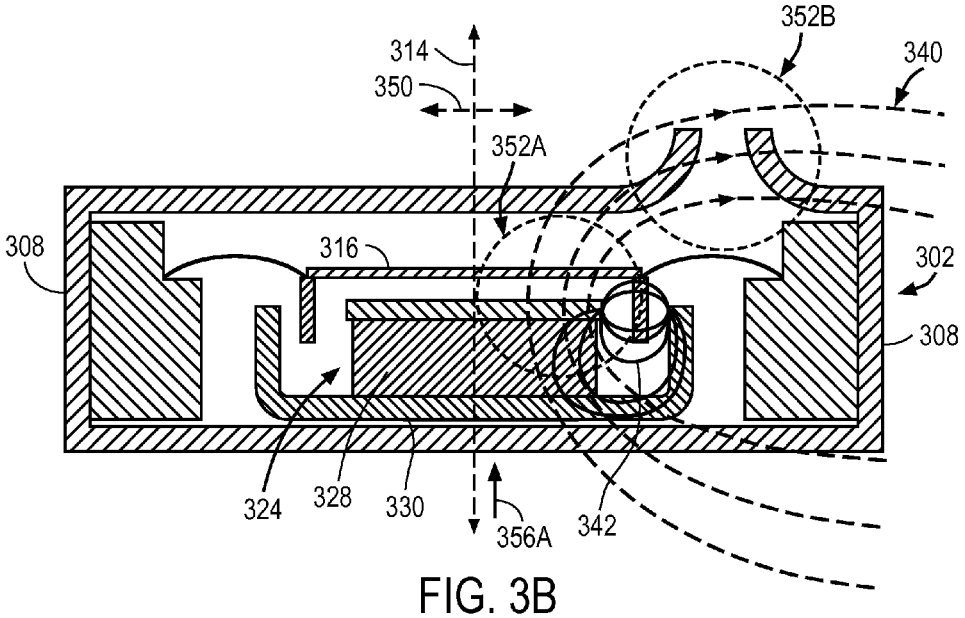
FIG. 3B illustrates a magnetic field of the magnetic motor arrangement of FIG. 3A.

Similar to the acoustic spout described in reference to FIG. 1A, acoustic spout 312 has a z-height dimension that helps to reduce the pathway for particle ingress as compared to an acoustic opening that does not include a spout as previously discussed. In addition, spout 312 is arranged with respect to magnet assembly 324 such that spout 312 and acoustic port 310 are outside of the magnetic field, within a region of reduced magnetic field or a portion of the magnetic field that would otherwise draw particles, for example metallic or magnetic particles (e.g. iron filings), into acoustic port 310. Such arrangement is illustrated in FIG. 3B. For example, where magnet 328 is a center magnet, the acoustic spout 312 is positioned such that it is axially offset with respect to the center magnet (i.e. to a side of the center magnet and not directly over the center magnet).

FIG. 3B illustrates a magnetic field of the magnetic motor arrangement of FIG. 3A. As can be seen from FIG. 3B, magnet assembly 324 produces a magnetic field having a main flux component 342 concentrated between magnet 328 and yoke 330 and a stray flux component 340. As can be seen from FIG. 3B, the stray flux component 340 follows a substantially elliptical path between magnet 328 and yoke 330. In this aspect, portions of the stray flux component 340 can be considered aligned with a vertical axis 314 of magnet 328, in other words they are axially aligned flux lines, while other portions can be considered aligned with a radial dimension 350 of magnet 328, in other words they are radially aligned flux lines. The axially aligned flux lines of the stray flux component 340 are considered to be those lines within the dashed region 352A shown in FIG. 3B. The radially aligned flux lines of stray flux component 340 are considered to be those lines within the dashed region 352B shown in FIG. 3B. In other words, region 352A is considered the area of the magnetic field dominated by the axial flux lines because it has more flux lines in the axial direction than the radial direction, in other words, more axial flux lines than radial flux lines. The region 352B is, in turn, considered the areas of magnetic field dominated by the radial flux lines because it has more flux lines in the radial direction than the axial direction, in other words, more radial flux lines than axial flux lines.

Acoustic port 310, and in turn spout 312, is positioned such that it is outside of region 352A such that the axially aligned flux lines generated by magnet assembly 324 are not aligned with the acoustic opening 310 and spout 312 and therefore not be able to affect particles near spout 312. In other words, spout 312 is positioned outside of the area of the magnetic field dominated by the axial flux lines. Said another way, spout 312 is positioned such that it is not aligned with the magnetic field dominated by the axial component. To accomplish this, spout 312 could be positioned entirely outside of the magnetic field and thus an area of reduced magnetic field, or within the magnetic field, but within an area where the strength of the magnetic field is reduced, for example, outside of the area dominated by the axial flux lines (i.e. the area where there are more axial flux lines than radial flux lines). Said another way, spout 312 is offset with respect to the axis 314 of magnet 328 or not directly above magnet 328, and in turn, the axially aligned flux lines. Thus, in some embodiments, spout 312 is positioned entirely outside of a footprint of magnet 328 such that it is outside of an area of the magnetic field dominated by the axial flux lines. Said another way, spout 312 may be off to the side of magnet 328, for example, extending from a portion of top wall 304 between magnet assembly 324 and sidewall 308, and within a portion of the magnetic field dominated by the radial flux lines (i.e. within region 352B). As can be seen from the arrows indicating the direction of magnetic pull generated by the radial flux lines within region 352B the radially aligned flux lines have a radially outward magnetic pull. Since the magnetic pull is outward or radial, the radial flux lines do not pull particles in through spout 312 and therefore do not contribute to particle ingress through spout 312. Rather, it has been found that positioning spout 112 within the radial flux lines, or a region of the magnetic field dominated by the radial flux lines (i.e. more radial flux lines than axial flux lines) may actually further reduce metallic or magnetic particle ingress through spout 312 because, for example, the radial flux lines may pull the particles across spout 312 rather than into spout 312.

Figure 4A:
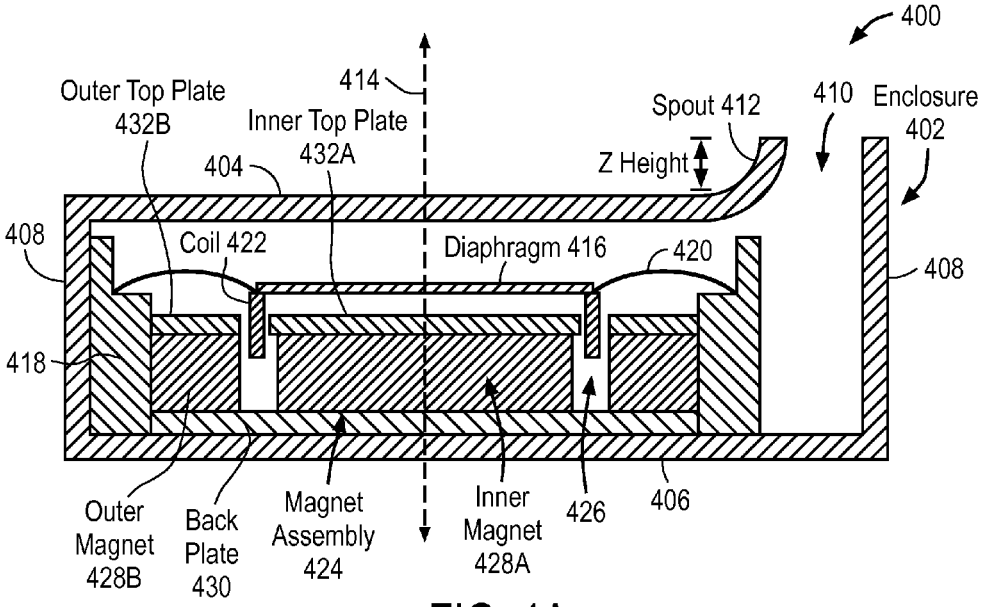
FIG. 4A illustrates a cross-sectional side view of another embodiment of a magnetic motor arrangement in a transducer.

FIG. 4A illustrates a cross-sectional side view of another embodiment of a magnetic motor arrangement in a transducer. Transducer 400 may be similar to transducer 100 described in reference to FIG. 1A, for example, an electro-acoustic transducer that converts electrical signals into audible signals that can be output from a device within which transducer 400 is integrated. For example, transducer 400 may be a loudspeaker such as a microspeaker or earpiece found within a smart phone, or other similar relatively compact electronic device such as a laptop, notebook, or tablet computer. Transducer 400 may be enclosed within a housing or enclosure 402 having a top wall 404, a bottom wall 406 and one or more sidewalls 408 connecting top wall 404 to bottom wall 406. Enclosure 402 may further include an acoustic spout 412 extending from one of top wall 404, bottom wall 406 or sidewalls 408. Acoustic spout 412 may define an acoustic port 410 that provides a sound outlet port through which sound generated by transducer 400 can be output to the ambient environment. In the illustrated embodiment of FIG. 4A, acoustic spout 412, and in turn acoustic port 410, is formed on top wall 404, in other words, above diaphragm 416. In this aspect, transducer 400 may be considered a front-ported device. Acoustic spout 412 may, however, be formed through another wall of enclosure 402, for example, bottom wall 406 such that transducer 400 is considered a back or bottom-ported device.

Acoustic spout 412 may be substantially similar to acoustic spout 112 described in reference to FIG. 1A. In this aspect, acoustic spout 412 may form a lip like projection through which sound generated by transducer 400 can travel to the ambient environment. Spout 412 may be designed to limit the area that particles can directly ingress through acoustic port 410 and/or limit the direction that particles can ingress. In this aspect, spout 412 helps to reduce particle ingress into transducer 400, as compared to a transducer having an opening through the wall without any sort of projection or spout 412. For example, spout 412 may have a z-height dimension that extends far enough from the surface of the enclosure wall such that off-axis particles traveling towards acoustic port 410 (i.e. particles traveling at an angle with respect to device axis 414) are blocked from entering acoustic port 410 by spout 412. In addition, because of the z-height of spout 412, particles traveling along the outer wall of enclosure 402 may be deflected up and away from acoustic port 410 by the walls of spout 412.

Diaphragm 416 is suspended from a frame 418 mounted within enclosure 402 by a suspension member 420. Diaphragm 416 may include a sound radiating surface and be any type of diaphragm or sound radiating surface capable of vibrating in response to an acoustic signal to produce acoustic or sound waves. Transducer 400 may also include a voice coil 422. Voice coil 422 may be positioned along a face of diaphragm 416 and within a gap 426 formed by magnet assembly 424. In this embodiment, voice coil 422 may be positioned along a bottom face of diaphragm 416 (i.e. a side of diaphragm 416 facing bottom wall 406) and magnet assembly 424 may, in turn, be positioned below or under the bottom face of diaphragm 416 (i.e. between diaphragm 416 and bottom wall 406).

Magnet assembly 424 may include a center or inner magnet 428A and an outer magnet 428B (e.g. a NdFeB magnet), an inner top plate 432A over inner magnet 428A, an outer top plate 432B over outer magnet 428B and a bottom or back plate 430 for guiding a magnetic circuit generated by inner magnet 428A and outer magnet 428B. In one embodiment, inner magnet 428A may be void of any openings, in other words solid without any hollow regions. Magnet assembly 424 may be positioned below diaphragm 416, in other words, in this embodiment, magnet assembly 424 is between diaphragm 416 and bottom wall 406. Gap 426, within which voice coil 422 is positioned, may be formed between inner magnet 428A and outer magnet 428B. Representatively, in one embodiment, inner magnet 428A may be center magnet that is positioned within coil 422 and outer magnet 428B may be positioned around coil 422 such that coil 422 is between inner magnet 428A and outer magnet 428B. In this aspect, the magnetic field produced by the magnetic circuit of magnet assembly 424 can be used to drive movement of coil 422, which in turn, vibrates diaphragm 416 in a manner sufficient to produce the desired acoustic output from transducer 400.

Similar to the acoustic spout described in reference to FIG. 1A, acoustic spout 412 has a z-height dimension sufficient to reduce the pathway for particle ingress as compared to an acoustic opening that does not include a spout as previously discussed. In addition, spout 412 is arranged with respect to magnet assembly 424 such that it is outside of the magnetic field, or a portion of the magnetic field that would draw particles, for example metallic or magnetic particles (e.g. iron filings), into acoustic port 410. Such arrangement is illustrated in FIG. 4B.

Figure 4B:
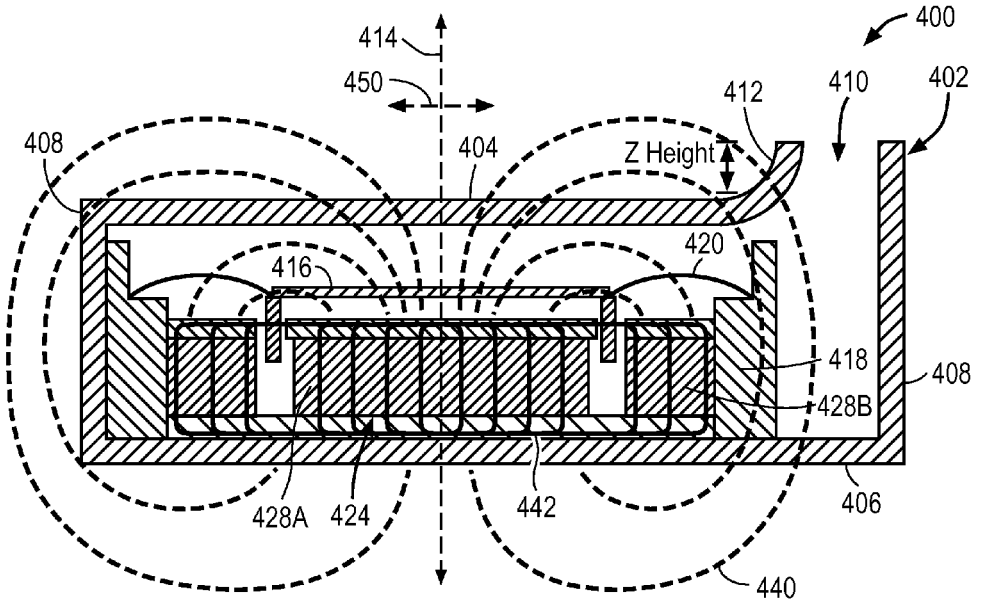
FIG. 4B illustrates a magnetic field of the magnetic motor arrangement of FIG. 4A.

FIG. 4B illustrates a magnetic field of the magnetic motor arrangement of FIG. 4A. As can be seen from FIG. 4B, magnet assembly 424 produces a magnetic field having a stray flux component 440 (illustrated by dashed lines) and a main flux component 442 (illustrated by solid lines). The main flux component 442 is concentrated between inner magnet 428A and outer magnet 428B. The main flux component 442 is designed to drive movement of the coil 422. As can be seen from FIG. 4B, the stray flux component 440 and the main flux component 442 follow a substantially elliptical path. In this aspect, portions of the stray flux component 440 and the main flux component 442 can be considered aligned with a vertical axis 414 of magnet assembly 424, in other words they are axially aligned flux lines, while other portions can be considered aligned with a radial dimension 450 of magnet assembly 424, in other words they are radially aligned flux lines.

In general, the axially aligned flux lines can have a vertically aligned magnetic pull. In addition, the radially aligned flux lines can have a radially aligned pull. Acoustic port 410, and in turn spout 412, is positioned such that the axially aligned component is not aligned with the acoustic opening 410 and spout 412 and therefore not be able to pull particles in through spout 412. In other words, spout 412 is positioned outside of the area of the magnetic field dominated by the axial flux lines. Said another way, spout 412 is positioned such that it is not aligned with the magnetic pull created by the axial flux lines. To accomplish this, spout 412 could be positioned entirely outside of the magnetic field or within the magnetic field, but within an area where the strength of the magnetic field is reduced, for example, outside of the area dominated by the axial flux lines (i.e. the area where there are more axial flux lines than radial flux lines) or the main flux component 442. Said another way, spout 412 is offset with respect to the axis 414 of magnet 428 and, in turn, the axially aligned flux lines. Thus, in some embodiments, spout 412 is positioned entirely outside of a footprint of magnet 428 such that it is outside of an area of the magnetic field dominated by the axial flux lines. Said another way, spout 412 may be off to the side of magnet 428 and frame 418. For example, in one embodiment, spout 412 may extend from a portion of top wall 404 that is between magnet assembly 424 and sidewall 408 (i.e. over the area between magnet assembly 424 and sidewall 408), for example, formed by a portion of sidewall 408 such that it is adjacent to sidewall 408, and entirely outside of the magnetic field.

Figure 5:
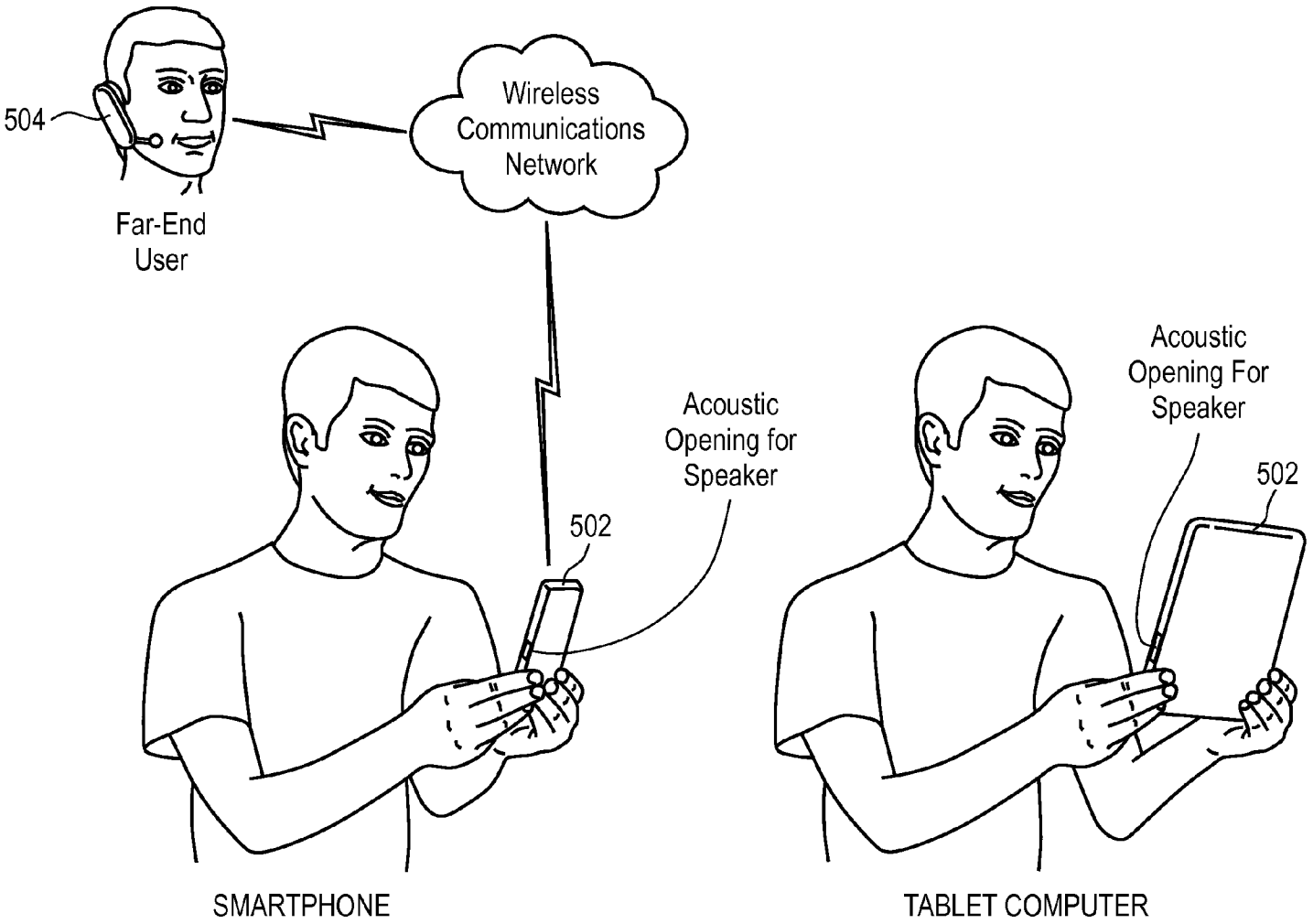
FIG. 5 illustrates one embodiment of a simplified schematic view of one embodiment of an electronic device in which an embodiment of the invention may be implemented.

FIG. 5 illustrates one embodiment of a simplified schematic view of one embodiment of an electronic device in which a transducer, such as that described herein, may be implemented. As seen in FIG. 5, the transducer may be integrated within a consumer electronic device 502 such as a smart phone with which a user can conduct a call with a far-end user of a communications device 504 over a wireless communications network; in another example, the transducer may be integrated within the housing of a tablet computer. These are just two examples of where the transducer described herein may be used, it is contemplated, however, that the transducer may be used with any type of electronic device in which a transducer, for example, a loudspeaker or receiver, is desired, for example, a tablet computer, a desk top computing device or other display device.

Figure 6:
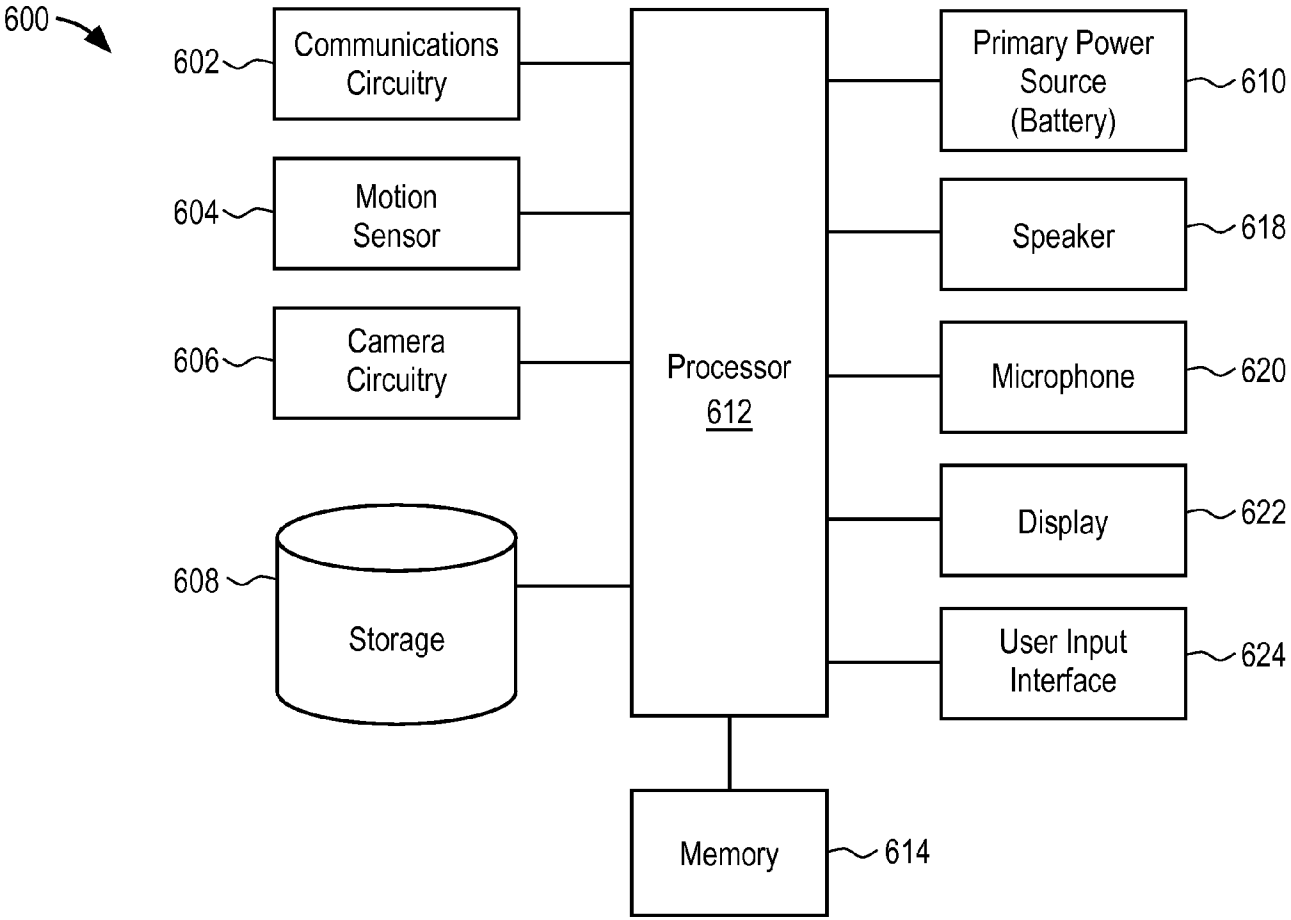
FIG. 6 illustrates a block diagram of some of the constituent components of an embodiment of an electronic device in which an embodiment of the invention may be implemented.

FIG. 6 illustrates a block diagram of some of the constituent components of an embodiment of an electronic device in which an embodiment of the invention may be implemented. Device 600 may be any one of several different types of consumer electronic devices. For example, the device 600 may be any transducer-equipped mobile device, such as a cellular phone, a smart phone, a media player, or a tablet-like portable computer.

In this aspect, electronic device 600 includes a processor 612 that interacts with camera circuitry 606, motion sensor 604, storage 608, memory 614, display 622, and user input interface 624. Main processor 612 may also interact with communications circuitry 602, primary power source 610, speaker 618, and microphone 620. Speaker 618 may be a microspeaker such as that described in reference to FIG. 1A. The various components of the electronic device 600 may be digitally interconnected and used or managed by a software stack being executed by the processor 612. Many of the components shown or described here may be implemented as one or more dedicated hardware units and/or a programmed processor (software being executed by a processor, e.g., the processor 612).

The processor 612 controls the overall operation of the device 600 by performing some or all of the operations of one or more applications or operating system programs implemented on the device 600, by executing instructions for it (software code and data) that may be found in the storage 608. The processor 612 may, for example, drive the display 622 and receive user inputs through the user input interface 624 (which may be integrated with the display 622 as part of a single, touch sensitive display panel). In addition, processor 612 may send an audio signal to speaker 618 to facilitate operation of speaker 618.

Storage 608 provides a relatively large amount of "permanent" data storage, using nonvolatile solid state memory (e.g., flash storage) and/or a kinetic nonvolatile storage device (e.g., rotating magnetic disk drive). Storage 608 may include both local storage and storage space on a remote server. Storage 608 may store data as well as software components that control and manage, at a higher level, the different functions of the device 600.

In addition to storage 608, there may be memory 614, also referred to as main memory or program memory, which provides relatively fast access to stored code and data that is being executed by the processor 612. Memory 614 may include solid state random access memory (RAM), e.g., static RAM or dynamic RAM. There may be one or more processors, e.g., processor 612, that run or execute various software programs, modules, or sets of instructions (e.g., applications) that, while stored permanently in the storage 608, have been transferred to the memory 614 for execution, to perform the various functions described above.

The device 600 may include communications circuitry 602. Communications circuitry 602 may include components used for wired or wireless communications, such as two-way conversations and data transfers. For example, communications circuitry 602 may include RF communications circuitry that is coupled to an antenna, so that the user of the device 600 can place or receive a call through a wireless communications network. The RF communications circuitry may include a RF transceiver and a cellular baseband processor to enable the call through a cellular network. For example, communications circuitry 602 may include Wi-Fi communications circuitry so that the user of the device 600 may place or initiate a call using voice over Internet Protocol (VOIP) connection, transfer data through a wireless local area network.

The device may include a microphone 620. Microphone 620 may be an acoustic-to-electric transducer or sensor that converts sound in air into an electrical signal. The microphone circuitry may be electrically connected to processor 612 and power source 610 to facilitate the microphone operation (e.g. tilting).

The device 600 may include a motion sensor 604, also referred to as an inertial sensor, that may be used to detect movement of the device 600. The motion sensor 604 may include a position, orientation, or movement (POM) sensor, such as an accelerometer, a gyroscope, a light sensor, an infrared (IR) sensor, a proximity sensor, a capacitive proximity sensor, an acoustic sensor, a sonic or sonar sensor, a radar sensor, an image sensor, a video sensor, a global positioning (GPS) detector, an RF or acoustic doppler detector, a compass, a magnetometer, or other like sensor. For example, the motion sensor 604 may be a light sensor that detects movement or absence of movement of the device 600, by detecting the intensity of ambient light or a sudden change in the intensity of ambient light. The motion sensor 604 generates a signal based on at least one of a position, orientation, and movement of the device 600. The signal may include the character of the motion, such as acceleration, velocity, direction, directional change, duration, amplitude, frequency, or any other characterization of movement. The processor 612 receives the sensor signal and controls one or more operations of the device 600 based in part on the sensor signal.

The device 600 also includes camera circuitry 606 that implements the digital camera functionality of the device 600. One or more solid state image sensors are built into the device 600, and each may be located at a focal plane of an optical system that includes a respective lens. An optical image of a scene within the camera's field of view is formed on the image sensor, and the sensor responds by capturing the scene in the form of a digital image or picture consisting of pixels that may then be stored in storage 608. The camera circuitry 606 may also be used to capture video images of a scene.

Device 600 also includes primary power source 610, such as a built in battery, as a primary power supply.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the devices and processing steps disclosed herein may correspond to any type of transducer that could benefit from reduced magnetic particle ingress, for example, an acoustic-to-electric transducer such as a microphone. The description is thus to be regarded as illustrative instead of limiting.

What is claimed is:

1. An electromechanical transducer comprising:

a magnetic circuit having a magnet configured to generate a magnetic field and an annularly shaped magnetic gap into which a voice coil associated with a diaphragm is at least partially inserted, the magnetic field having a primary flux component and a secondary flux component; and a housing positioned around the magnetic circuit, the housing having an acoustic spout that forms a sound outlet opening for outputting sound from the housing, and wherein the acoustic spout is positioned outside of a portion of the magnetic field that is dominated by the primary flux component such that a strength of the magnetic field at the acoustic spout is 10 mT to 30 mT less than a strength of the magnetic field over the magnet and the acoustic spout extends from an outer surface of the housing a distance sufficient to deflect a particle traveling in a direction that is off-axis with respect to an axis of the acoustic spout and toward the acoustic spout, away from the sound outlet opening.

2. The transducer of claim 1 wherein the portion of the magnetic field dominated by the primary flux component has a higher magnetic flux density than a portion of the magnetic field dominated by the secondary flux component.

3. The transducer of claim 1 wherein the acoustic spout is positioned within a portion of the magnetic field dominated by a radial component of the secondary flux component.

4. The transducer of claim 1 wherein the magnet is a continuous ring magnet or a set of discrete magnets around an outside of the coil and the acoustic spout is positioned such that it is axially aligned with an open center of the magnet.

5. The transducer of claim 1 wherein the magnet is a center magnet and the acoustic spout is positioned such that it is axially offset with respect to the center magnet.

6. The transducer of claim 1 wherein the diaphragm is positioned between the acoustic spout and the magnet.

7. The transducer of claim 1 wherein the magnet is positioned between the acoustic spout and the diaphragm.

8. The transducer of claim 1 further comprising:

a yoke having a base portion positioned along a bottom side or a top side of the magnet and an arm portion positioned within an open center portion of the magnet such that the annularly shaped magnetic gap is formed between the magnet and the arm portion.

9. The transducer of claim 1 wherein the acoustic spout extends in a direction from the outer surface of the housing that is parallel to an axis of the housing.

10. The transducer of claim 1 wherein the electromechanical transducer is a microspeaker.

11. An electromechanical transducer comprising:

an enclosure having a top wall, a bottom wall, at least one side wall connecting the top wall to the bottom wall and an acoustic spout extending from an outer surface of the top wall, and the acoustic spout defines an acoustic opening through the enclosure, and the acoustic opening provides the only acoustic pathway for sound outlet from the enclosure;

a diaphragm positioned within the enclosure;

a voice coil positioned along a face of the diaphragm; and a magnet assembly positioned along the bottom wall of the enclosure, the magnet assembly having a ring magnet and a yoke, the yoke having a base portion positioned along a surface of the ring magnet facing the top wall of the enclosure and an arm portion that extends from the base portion into an opening of the ring magnet, and gap is formed within the opening of the ring magnet by the arm portion and a side of the ring magnet forming the opening, wherein a portion of the voice coil is positioned within the gap and the acoustic spout is positioned over the opening.

12. The transducer of claim 11 wherein the ring magnet is positioned only around an outer surface of the voice coil.

13. The transducer of claim 11 wherein the acoustic spout is positioned entirely outside of a magnetic field generated by the magnet assembly.

14. The transducer of claim 11 wherein the diaphragm is positioned between the acoustic spout and the ring magnet.

15. The transducer of claim 11 wherein the ring magnet is positioned between the acoustic spout and the diaphragm.

16. The transducer of claim 11 wherein the acoustic spout comprises a z-height dimension operable to control particle ingress into the enclosure.

17. The transducer of claim 11 wherein a strength of the magnetic field at the acoustic spout is 10 mT to 30 mT less than a strength of a magnetic filed over the ring magnet.

18. An electromechanical transducer comprising:

an enclosure having a top wall, a bottom wall, at least one side wall connecting the top wall to the bottom wall and an acoustic spout;

a diaphragm positioned within the enclosure;

a voice coil positioned along a face of the diaphragm; and a magnet assembly positioned on the bottom wall and forming a gap within which a portion of the voice coil is positioned, the magnet assembly having a magnet and a frame positioned along a side of the magnet, and wherein the frame is positioned on the bottom wall a distance from the at least one sidewall such that a space is formed between the frame and the at least one side wall, the acoustic spout extends from the top wall and is between the frame and the at least one sidewall such that an acoustic pathway formed by the acoustic spout is aligned with the space formed between the frame and the at least one sidewall, and wherein at least one wall of the acoustic spout is within a same plane as the at least one sidewall and the acoustic pathway is perpendicular to a surface of the top wall.

19. The transducer of claim 18 wherein the magnet comprises a center magnet void of any openings.

* * * * *